US006622329B2

(12) United States Patent
Ostor et al.

(10) Patent No.: US 6,622,329 B2
(45) Date of Patent: Sep. 23, 2003

(54) 3-PIECE BICYCLE TOOL ASSEMBLY

(75) Inventors: Pierre Ostor, White Bear Lake, MN (US); John Krawczyk, Woodbury, MN (US)

(73) Assignee: Bicycle Tools Incorporated, St. Paul, MN (US)

( * ) Notice: Subject to any disclaimer, the term of this patent is extended or adjusted under 35 U.S.C. 154(b) by 0 days.

(21) Appl. No.: 09/965,559

(22) Filed: Sep. 27, 2001

(65) Prior Publication Data

US 2003/0056294 A1 Mar. 27, 2003

(51) Int. Cl.[7] ..... B25B 13/00
(52) U.S. Cl. ..... 7/138; 7/168
(58) Field of Search ..... 7/138, 167, 168, 7/151

(56) References Cited

U.S. PATENT DOCUMENTS

| | | | | | |
|---|---|---|---|---|---|
| 635,562 | A | | 10/1899 | Marschutz et al. | |
| 1,369,829 | A | | 3/1921 | Minges | |
| 1,398,583 | A | | 11/1921 | Bovee | |
| 2,804,970 | A | | 9/1957 | Kuc et al. | |
| 2,828,855 | A | | 4/1958 | Mosch | |
| 4,238,862 | A | | 12/1980 | Leatherman | |
| 4,744,272 | A | | 5/1988 | Leatherman | |
| 4,854,045 | A | | 8/1989 | Schaub | |
| 4,888,869 | A | | 12/1989 | Leatherman | |
| 4,908,947 | A | | 3/1990 | Schaub | |
| 5,146,815 | A | | 9/1992 | Scott, III | |
| 5,303,439 | A | * | 4/1994 | Seals | 7/138 |
| 5,313,860 | A | | 5/1994 | Liou | |
| 5,320,004 | A | * | 6/1994 | Hsiao | 81/177.4 |
| 5,450,774 | A | | 9/1995 | Chang | |
| 5,581,834 | A | | 12/1996 | Collins | |
| 5,588,169 | A | * | 12/1996 | Chuang | 7/138 |
| 5,632,056 | A | * | 5/1997 | Hsiao | 7/138 |
| 5,655,242 | A | * | 8/1997 | Chuang | 7/138 |
| 5,711,042 | A | * | 1/1998 | Chuang | 7/138 |
| 5,711,194 | A | | 1/1998 | Anderson et al. | |
| D401,133 | S | | 11/1998 | Gardiner et al. | |
| D406,508 | S | | 3/1999 | Rivera | |
| D408,238 | S | | 4/1999 | Rivera | |
| D410,369 | S | | 6/1999 | Yeh | |
| 6,014,787 | A | | 1/2000 | Rivera | |
| D420,874 | S | | 2/2000 | Berg et al. | |
| D421,377 | S | | 3/2000 | Rivera | |
| 6,047,426 | A | | 4/2000 | McIntosh et al. | |
| 6,065,213 | A | | 5/2000 | Rivera | |
| D427,496 | S | | 7/2000 | Berg | |
| D427,501 | S | | 7/2000 | Berg | |
| D427,868 | S | | 7/2000 | Rivera | |
| 6,092,444 | A | | 7/2000 | Hsiao | |
| D428,791 | S | | 8/2000 | Anderson et al. | |
| D429,131 | S | | 8/2000 | Rivera | |
| D429,132 | S | | 8/2000 | Rivera | |
| D429,616 | S | | 8/2000 | Rivera | |
| D429,621 | S | | 8/2000 | Rivera | |
| D429,989 | S | | 8/2000 | Rivera | |
| 6,112,351 | A | * | 9/2000 | Hawkins et al. | 7/138 |
| 6,128,805 | A | | 10/2000 | Rivera | |
| D433,902 | S | | 11/2000 | Rivera | |
| 6,161,273 | A | | 12/2000 | Rivera et al. | |
| D436,514 | S | | 1/2001 | Rivera | |
| 6,216,301 | B1 | | 4/2001 | Rivera | |
| 6,220,127 | B1 | | 4/2001 | Berg et al. | |
| 6,286,168 | B1 | * | 9/2001 | Woodruff et al. | 7/138 |

* cited by examiner

*Primary Examiner*—James G. Smith
(74) *Attorney, Agent, or Firm*—Gerald E. Helget; Nelson Capes; Briggs and Morgan

(57) ABSTRACT

A three-piece bicycle tool assembly consists of a first tool carrier, a second tool carrier, and an engagement member separate from and slidingly engaging the first tool carrier and the second tool carrier. The first tool carrier and the second tool carrier each have a number of tools pivotably engaged thereon. A chain repair tool on the engagement member is held between the first tool carrier and the second tool carrier so that it is not substantially exposed.

11 Claims, 3 Drawing Sheets

3-PIECE BICYCLE TOOL ASSEMBLY

BACKGROUND OF THE INVENTION

This invention relates to hand tools and more particularly to a 3-piece multipurpose bicycle repair and maintenance tool kit with a chain repair tool that is enclosed between two halves that prevents the tool from damaging a backpack or other tool carrier. The present invention is a compact bicycle tool kit that is easily carried on the bicycle or by the rider for use if a breakdown occurs or an adjustment needs to be made on the road.

Bicyclists have long been plagued with the problem of minor breakdowns occurring while riding when they are far from help or access to repair equipment. Because of the excess weight and limited storage space, conventional tools are seldom transported along with the bike for repair and adjustment purposes. The majority of problems occurring on conventional bicycles can be fixed or adjusted with only a few specific tools. Combining these specific tools into one lightweight compact unit would be particularly useful to the rider.

U.S. Pat. No. 5,711,042 (Chang) shows a tool combination for a bicycle. However, the tools in this patent are unprotected by any sort of enclosure. Therefore, if the tool set is carried in a backpack or in a soft bicycle tool carrier, the sharp tools may cause damage. Also, if the rider reaches into the backpack or carrier, and one of the tools has opened, he may cut his fingers. Also, the two halves of the tool set are held together by a complex locking mechanism, increasing the cost of manufacture.

U.S. Pat. No. 6,112,351 (Hawkins) shows a tool combination for a bicycle. The apparatus includes two clam shell halves that enclose the tools. However, it is necessary to separate the two clam shell halves to gain access to the tools.

There is a need for a bicycle tool set with an enclosure that protects the backpack and the fingers of the bicyclist from damage caused by the chain repair tool. The 3-piece tool assembly should have three parts which slide together to form the an enclosure without the need for a complicated locking mechanism. Also, the most commonly used tools should be readily accessible without the need to open an external case.

SUMMARY OF THE INVENTION

A three-piece bicycle tool assembly comprising:

a) a first tool carrier, the first tool carrier further comprising a plurality of first tools engaged therewith;

b) a second tool carrier, the second tool carrier further comprising a plurality of second tools engaged therewith; and c) an engagement member separate from the first tool carrier and second tool carrier and wherein the first tool carrier and the second tool carrier slidably engage the engagement member therebetween.

A principal object and advantage of the present invention is that the first tool carrier and the second tool carrier enclose the engagement member between them, so that tools mounted on the engagement member will not damage a backpack or the fingers of a bicyclist.

Another principal object and advantage of the present invention is that there is no need for a complicated locking mechanism to hold the first tool carrier and the second tool carrier together.

Another principal object and advantage of the present invention is that the most commonly used tools are accessible without the need to open an external case.

DETAILED DESCRIPTION OF THE PREFERRED EMBODIMENTS

Figure 1:
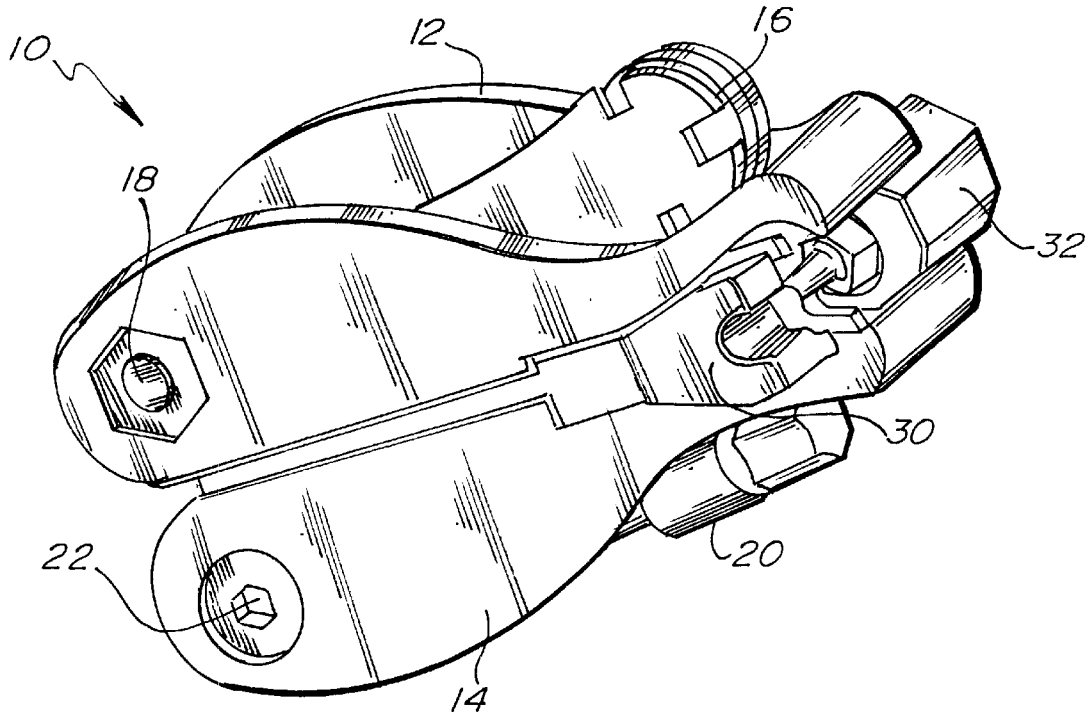
FIG. 1 is a perspective view of the 3-piece tool assembly of the present invention.
Figure 2:
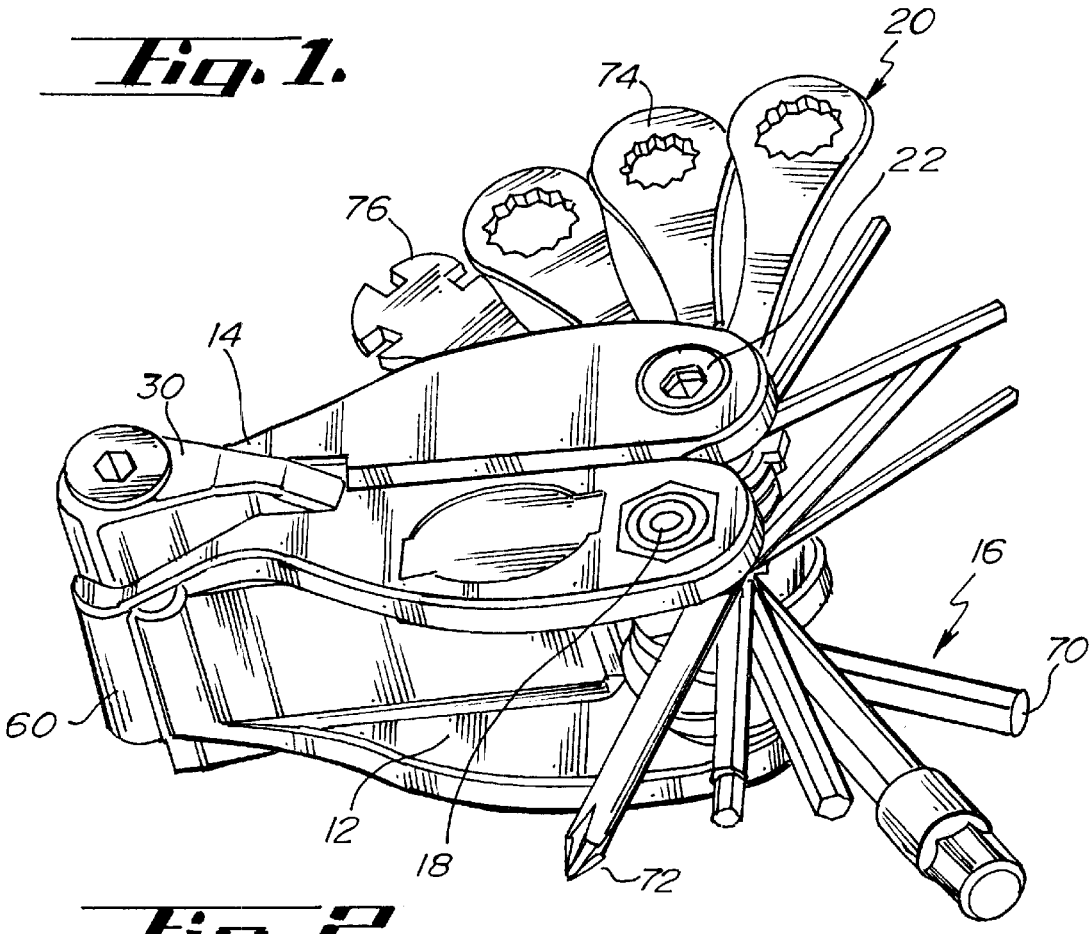
FIG. 2 is similar to FIG. 1, but showing the various tools deployed for use.
Figure 3:
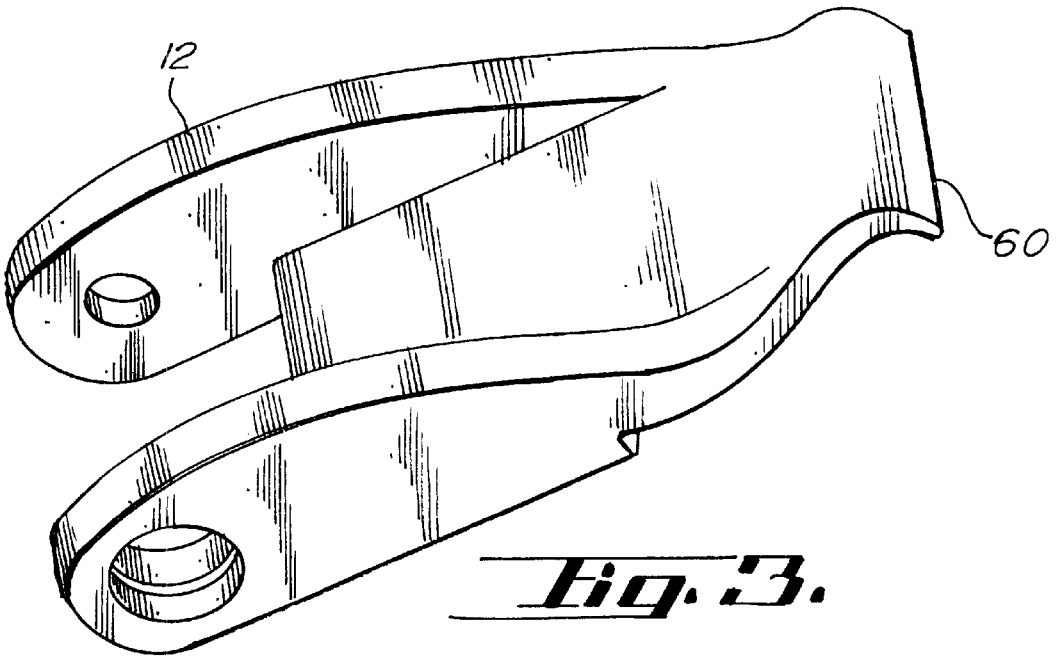
FIG. 3 is a perspective view of one of the tool carriers without the tools mounted thereon.
Figure 4:
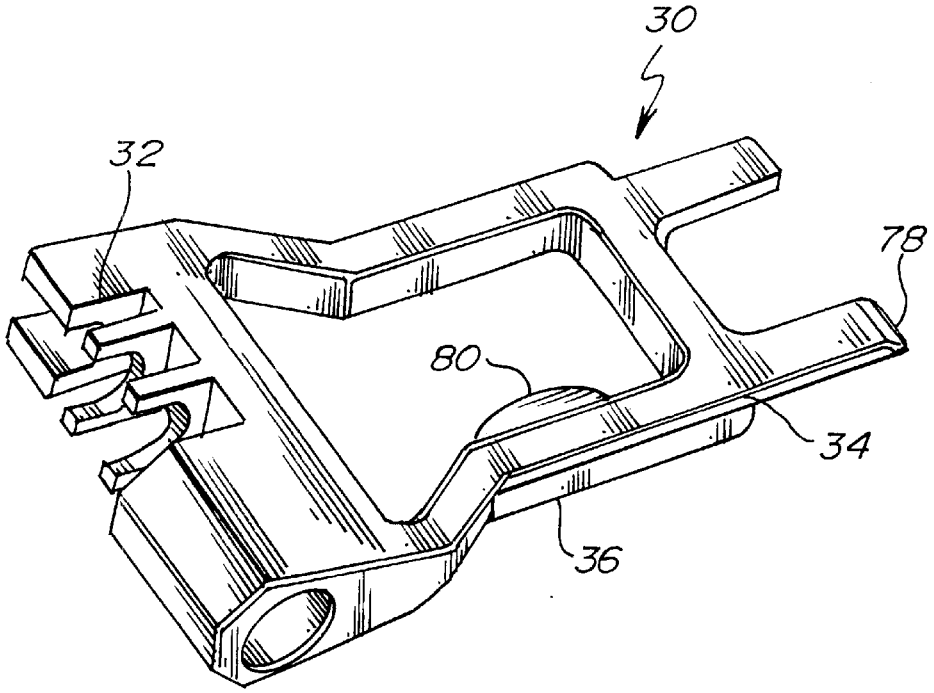
FIG. 4 is a perspective view of the engagement member.
Figure 5:
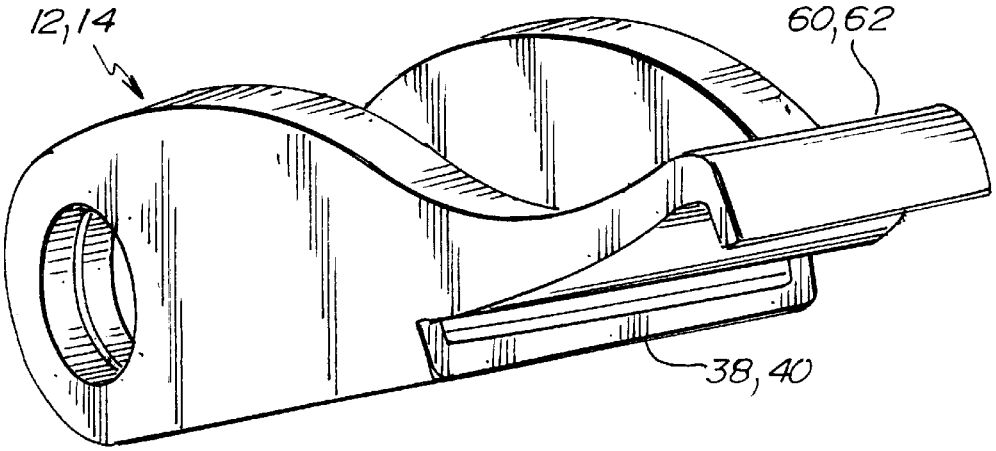
FIG. 5 is another perspective view of one of the tool carriers without the tools mounted thereon.
Figure 6:
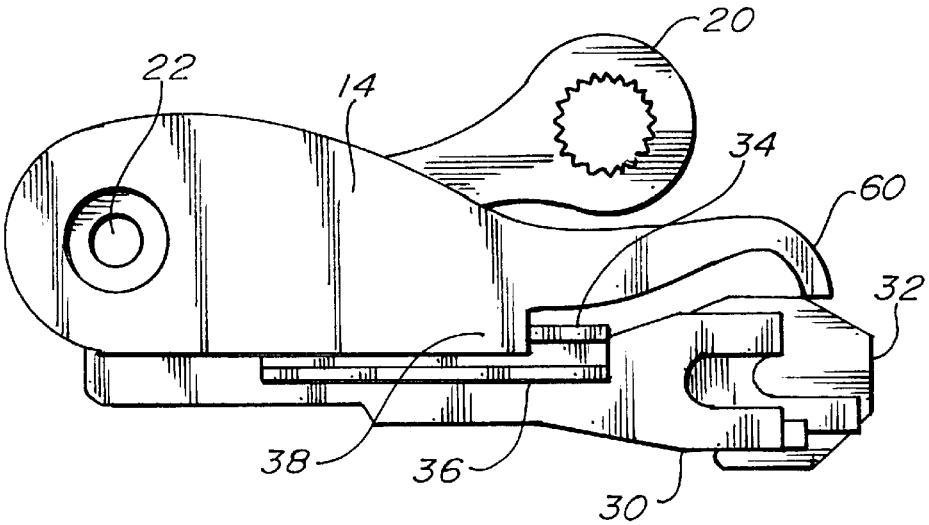
FIG. 6 is a cross sectional view of the present invention.

The 3-piece bicycle tool assembly apparatus of the present invention is generally shown in the Figures as reference numeral 10.

The 3-piece bicycle tool assembly 10 further comprises a first tool carrier 12 and a second tool carrier 14.

The first tool carrier 12 has a plurality of first tools 16 engaged therewith. Preferably, the plurality of first tools 16 are pivotally engaged with the first tool carrier, as by pivot pin 18.

The second tool carrier 14 has a plurality of second tools 20 engaged therewith. Preferably, the plurality of second tools are pivotally engaged with the second tool carrier, as by second pivot pin 22.

The 3-piece bicycle tool assembly 10 further comprises an engagement member 30 separate from the first tool carrier 12 and from the second tool carrier 14. The first tool carrier 12 and the second tool carrier 14 slidably engage the engagement member 30 therebetween. The engagement member may further comprise a chain repair tool 32.

The engagement member 30 preferably has a first tongue 34 and a second tongue 36. The first tool carrier has a first groove 38 and the second tool carrier has a second groove 40. The first tongue 34 slidably engages the first groove 38 and the second tongue 36 slidably engages the second groove 40.

The 3-piece bicycle tool assembly 10 may preferably further comprise a tire lever 60 on the first tool carrier 12. The 3-piece bicycle tool assembly 10 may also further comprise a second tire lever 62 on the second tool carrier 14. The tire lever 60 or 62 may be used to assist in removing or installing a tire on the wheel rim.

The plurality of first tools 16 may preferably further comprise at least one hex wrench 70. In the preferred embodiment, the plurality of first tools has six hex wrenches 70.

The plurality of second tools 20 may preferably further comprise a Phillips screwdriver 72.

The plurality of second tools 20 may preferably further comprise at least one box-end wrench 74. In the preferred embodiment, the plurality of second tools 20 comprises three box-end wrenches 74.

The plurality of second tools 20 may preferably further comprise at least one spoke wrench 76.

The plurality of second tools 20 may preferably further comprise a flat-head screwdriver 78.

The plurality of second tools 20 may preferably further comprise a bottle opener 80.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A three-piece bicycle tool assembly comprising:

a) a first tool carrier, the first tool carrier further comprising a plurality of first tools engaged therewith;

b) a second tool carrier, separate from the first tool carrier, the second tool carrier further comprising a plurality of second tools engaged therewith;

c) an engagement member separate from the first tool carrier and second tool carrier and wherein the first tool carrier and the second tool carrier slidably engage the engagement member therebetween to secure the first and the second tool carriers together; and d) wherein the plurality of first tools are pivotally engaged with the first tool carrier.

2. The three-piece bicycle tool assembly of claim 1, wherein the plurality of second tools are pivotally engaged with the second tool carrier.

3. The three-piece bicycle tool assembly of claim 1, further comprising a tire lever on the second tool carrier.

4. The three-piece bicycle tool assembly of claim 1, wherein the plurality of first tools further comprises at least one hex wrench.

5. The three-piece bicycle tool assembly of claim 1, wherein the plurality of second tools further comprises at least one Phillips screwdriver.

6. The three-piece bicycle tool assembly of claim 1, wherein the plurality of second tools further comprises at least one box-end wrench.

7. The three-piece bicycle tool assembly of claim 1, wherein the plurality of second tools further comprises at least one spoke wrench.

8. A three-piece bicycle tool assembly comprising:

a) a first tool carrier, the first tool carrier further comprising a plurality of first tools engaged therewith;

b) a second tool carrier, the second tool carrier further comprising a plurality of second tools engaged therewith; and c) an engagement member separate from the first tool carrier and second tool carrier and wherein the first tool carrier and the second tool carrier slidably engage the engagement member therebetween, the engagement member having a first tongue and second tongue, the first tool carrier having a first groove, the second tool carrier having a second groove, the first tongue slidably engaging the first groove and the second tongue slidably engaging the second groove.

9. A three-piece bicycle tool assembly comprising:

a) a first tool carrier, the first tool carrier further comprising a plurality of first tools engaged therewith;

b) a second tool carrier, the second tool carrier further comprising a plurality of second tools engaged therewith; and c) an engagement member separate from the first tool carrier and second tool carrier and wherein the first tool carrier and the second tool carrier slidably engage the engagement member therebetween, the engagement member having a first tongue and second tongue, the first tool carrier having a first groove, the second tool carrier having a second groove, the first tongue slidably engaging the first groove and the second tongue slidably engaging the second groove, wherein the engagement member further comprises a chain repair tool.

10. A three-piece bicycle tool assembly comprising:

a) a first tool carrier, the first tool carrier further comprising a plurality of first tools engaged therewith;

b) a second tool carrier, the second tool carrier further comprising a plurality of second tools engaged therewith; and c) an engagement member with a chain repair took separate from the first tool carrier and second tool carrier and wherein the first tool carrier and the second tool carrier slidably engage the engagement member therebetween.

11. A three-piece bicycle tool assembly comprising:

a) a first tool carrier, the first tool carrier further comprising a plurality of first tools engage therewith and a tire lever;

b) a second tool carrier, the second tool carrier further comprising a plurality of second tools engaged therewith and a tire lever; and c) an engagement member separate from the first tool carrier and second tool carrier and wherein the first tool carrier and the second tool carrier slidably engage the engagement member therebetween, wherein the plurality of first tools are pivotally engaged with the first tool carrier.

* * * * *